US009234405B2

(12) United States Patent
Brandsdal

(10) Patent No.: US 9,234,405 B2
(45) Date of Patent: Jan. 12, 2016

(54) DEVICE FOR A FLUID OPERATED VALVE BODY AND METHOD FOR OPERATION OF THE VALVE BODY

(75) Inventor: Viggo Brandsdal, Ytre Arna (NO)

(73) Assignee: TCO AS, Bergen (NO)

( * ) Notice: Subject to any disclaimer, the term of this patent is extended or adjusted under 35 U.S.C. 154(b) by 407 days.

(21) Appl. No.: 13/511,554

(22) PCT Filed: Nov. 29, 2010

(86) PCT No.: PCT/NO2010/000438

§ 371 (c)(1),
(2), (4) Date: Jun. 18, 2012

(87) PCT Pub. No.: WO2011/065843

PCT Pub. Date: Jun. 3, 2011

(65) Prior Publication Data

US 2012/0260999 A1 Oct. 18, 2012

(30) Foreign Application Priority Data

Nov. 27, 2009 (NO) ..... 20093421

(51) Int. Cl.
*E21B 34/10* (2006.01)

(52) U.S. Cl.
CPC ..... *E21B 34/10* (2013.01); *Y10T 137/0396* (2015.04)

(58) Field of Classification Search
CPC ..... E21B 34/10; E21B 34/14
USPC ..... 166/319, 323, 324, 332.2, 332.1
See application file for complete search history.

(56) References Cited

U.S. PATENT DOCUMENTS 4,687,055 A * 8/1987 Leggett ..... 166/72
7,331,392 B2 * 2/2008 Bosley et al. ..... 166/323
7,455,114 B2 * 11/2008 MacDougall ..... 166/373

* cited by examiner

*Primary Examiner* — Brad Harcourt
(74) *Attorney, Agent, or Firm* — Francis C. Hand; Carella, Byrne, et al

(57) ABSTRACT

A device is described for a fluid operated valve body 200 for activation of a fluid operated tool, said valve body 200 is connected to a pipe section 11 of a pipe 160 arranged in a well 120 in a formation 140, and the device is characterized in that the valve comprises a plunger piston 5 in a channel 232, which plunger piston 5 is reset from a closed to an open position to let fluid into the tool, said resetting takes place with a piston 210, said piston 210 is brought to a number of stepwise forwards and backwards movements by increasing and decreasing, respectively, the fluid pressure P2, and said movements affect a slide body 14 which is moved stepwise, in one direction, to a position where it opens for balls 8 to fall out of channel 232, thereby releasing the plunger piston 5 to move and open for fluid flow P to the fluid operated tool. The piston 210 is an extended body the one end of which is exposed to the pipe fluid, while the other end 212 is held pre-stressed by a pre-stressing body 15, where the slide movement takes place when the piston 210 moves as a consequence of said pressure release, and the pre-stressing body 15 is arranged in a chamber that is in open fluid connection with the well outside the pipe section, and the piston 210 is hydraulically balanced. The piston 210 affects the slide body 4 by teeth 239 on the slide body 4 and lifting arm 10 on the piston 210. A method for operation of the valve body is also described.

12 Claims, 5 Drawing Sheets

DEVICE FOR A FLUID OPERATED VALVE BODY AND METHOD FOR OPERATION OF THE VALVE BODY

The present invention relates to a device for a fluid operated valve body for activation of a fluid operated tool, said valve body can be connected to a pipe section of a pipe arranged in a well in a formation.

Also described is a method as given in the introduction in the subsequent claim 13.

The invention is particularly related to a new construction for a release body/tool which is used in a well to be able to activate different well equipment to initiate a necessary action, and where the equipment is activated by pulsing the pressure of the fluid that is in the well. Normally, such tools are constructed by a counting and step construction (counter system) where a piston or the like displaces a toothed rod or the like a given distance each time the operator on the surface increases the fluid pressure in the well, with such a pressure increase being followed by a pressure release. When the rod, after a given number of such pulses with high/low fluid pressure, is moved a sufficient distance forwards, it opens to let pressure fluid in through a channel to the construction itself that starts the action described above.

A such function, which brings about a uniform movement, is often denoted as a ratchet function, and is, for example, described in the GB patent GB 2,352,988 in connection to a fluid operated valve body. A pipe section is exposed to a pipe fluid pressure at its one end and moves a predetermined step with the cycle of increasing and decreasing of the pipe fluid pressure. After a predetermined number of pressure cycles the mechanism brings about the opening of a plunger piston which furthermore makes fluid communication to a fluid operated tool possible. The ratchet device comprises a pre-stressed body that works against the pipe fluid pressure and is exposed to the well fluid pressure.

Another example of a such tool with a step/counting function and which releases an appliance after a given number of pressure pulses, is described in the Norwegian patent 325.899.

If the activation was dependent on the fluid pressure reaching a given upper level only, the time of the release would be difficult to predict.

The appliance often talked about can be, for example, a valve that shall be opened, an explosive charge that shall be detonated to open up for inflow of oil from a formation to a production pipe, or a glass plug that seals the pipe and which shall be blown up.

With the help of said counting mechanism one can accurately predict the point of activation as one bases this on the number of steps up to the release and not how high the fluid pressure will be. But these systems can still be improved.

Examples of such well tools that can be activated are valves, gasket systems (packers), sliding sleeves, etc. These tools are normally operated in that one pressurises the pipe in which they are fitted as a part of from the surface a predetermined number of times. This is achieved through different types of valve systems that have been setup and react to pressure variations when these control mechanisms have registered (seen) the right sequence, then they open up for the well pressure and let in the fluid, and the tool can be operated.

These systems require that one has a system that is calibrated to the well depth the equipment is located at, to be able to compensate for the hydrostatic pressure in the well so that one gets the right pressure set from the surface in relation to the hydrostatic pressure.

These are time demanding operations as each tool must be calibrated for its specific job.

Today's systems also require that the pipe has a higher material thickness to solve the problem as one traditionally needs to use a very powerful spring or a nitrogen chamber to compensate for the hydraulic fluid pressure of the well.

Therefore it is an aim of the invention to provide a new construction that can eliminate the need for calibration of each individual well that the equipment shall be used in.

Furthermore, it is an aim to provide a system that is self-calibrating based on the hydrostatic pressure.

Furthermore, it is an aim to be able to contribute to that the pressure, which must be applied from the surface to the pipe, is always the same regardless of which depth the tool is fitted at.

Then one can mass produce the tools so simply and calibrate them such that they will always be required to supply a pressure of, for example, 100 bar at the surface independent of the hydrostatic pressure.

Furthermore, it is an aim to provide a solution that, when one has applied the correct number of pressure pulses, the system will open and let in the pressure to a chamber which is in connection with the activation mechanisms on the actual tool which shall be operated.

In addition, it is an important feature that such systems ought to have a possibility to open for activation of the tool at the moment one bleeds down (lowers) the pressure at the surface as one does not want that the tool shall be activated when there is an extra pressure in the system.

The device according to the present invention is characterised in that the valve comprises a release body that is reset from a closed to an open position to let fluid in to the tool, said resetting takes place with a release body, said release body is brought to a number of stepwise forward and back movements by increasing and decreasing, respectively, the pipe fluid pressure P2, and said movements affect a slide body which stepwise is moved to a position where it opens, with the release body being an extended body, the one end of which is exposed to the pipe fluid, while the other end is held pre-stressed by a pre-stressing body, where the slide movement occurs when the release body moves as a consequence of said pressure decrease, and the pre-stressing body is placed in a chamber which is in open fluid connection with the well outside the pipe section, and the release body is balanced hydraulically.

According to a preferred embodiment the pre-stressing body is a spiral spring that holds the release body in a pre-stressed upper position.

According to yet another preferred embodiment the pre-stressing body is a piston that is arranged in a boring through the wall of the valve body.

According to yet another preferred embodiment the piston comprises a rotary blocking hook that is set up to engage with the slide during the upward discharge movement of the piston for each pressure pulse.

According to yet another preferred embodiment the moveable slide is placed in a closed chamber that is sealed against the well pressure and pipe pressure, and where the chamber is set up to have a constant pressure during the whole of the pulsing operation until the plunge piston is pushed down and the fluid flows.

The other preferred embodiments appear in the dependent claims 6-12.

The method according to the invention is characterised in that:

1) an increased fluid pressure is set up in the pipe so that a piston in the wall section of the valve is pushed down against a pre-stressed force, 2) the pressure is released and the spring pushes the piston back, something that leads to one of the flappable blocking hooks fitted to the piston engaging with the slide and pushing it upwards one step, while one of the other blocking hooks 9 of the pipe engages with, and prevents, the slide from being pushed down again, 3) the steps 1 to 2 are repeated until the slide releases a channel so that the blocking bodies in the form of balls fall out of the channel, and a plunger piston falls down and gives an opportunity for the pipe fluid to flow into the slide chamber in the wall of the pipe casing, and further out into a channel system that leads up to the operation of different equipment in connection with a pipe stem where the release valve is fitted.

The slide moves preferably when the pipe pressure is partially released or completely vented so that the pipe pressure P2 is at its lowest when the fluid is let into the channel system.

According to a preferred embodiment a release valve with the constructions and functions that are defined in claims 1-14 is used.

The new mechanisms according to the invention shall be explained in more detail with reference to the enclosed figures, in which.

Figure 4:
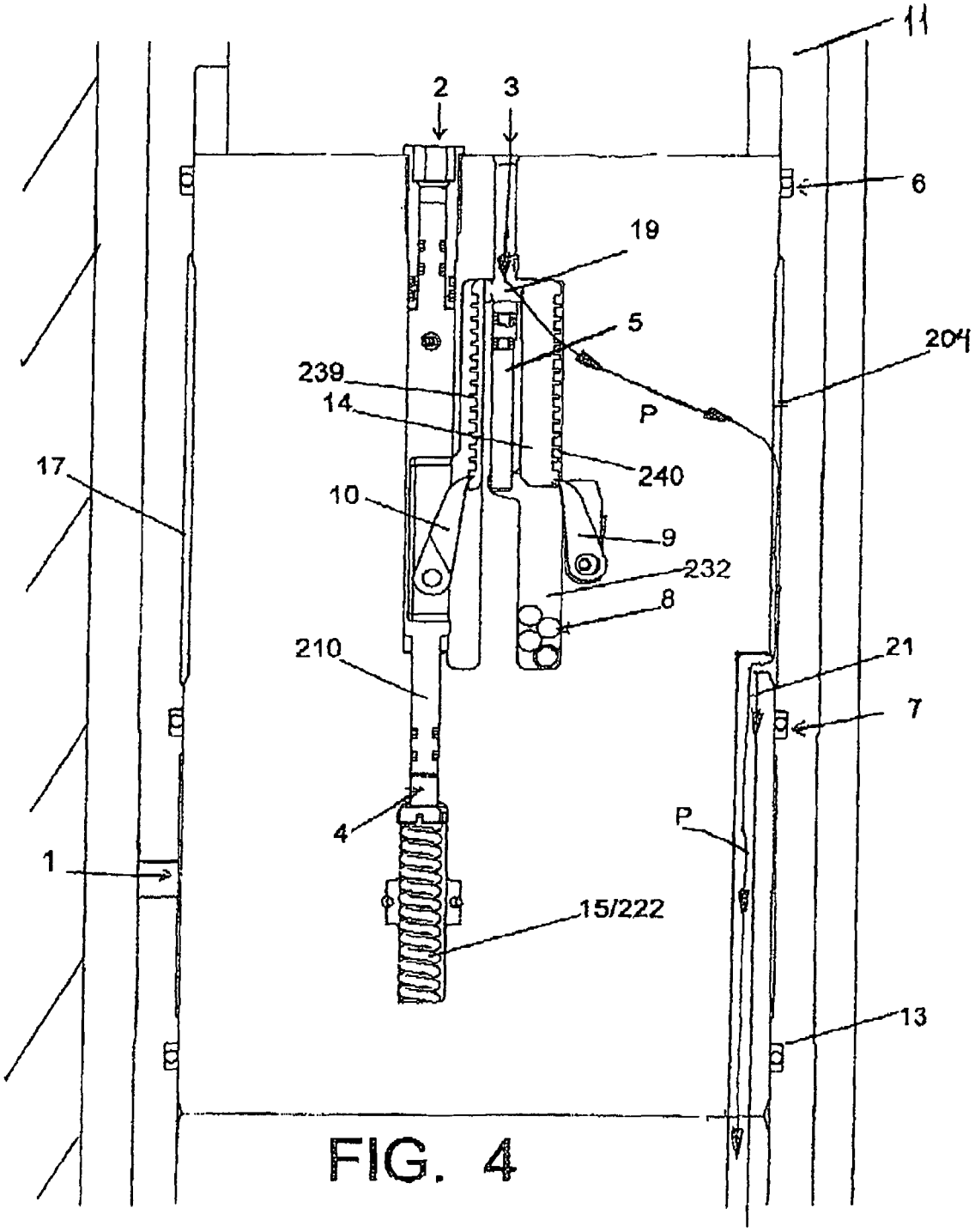

FIG. 4 shows the situation where the toothed slide has moved all the way up and opens for that the closing piston/plunger piston, which prevents inflow of the well fluid is pushed down by the fluid pressure outside and lets in fluid to the slide chamber of the casing and further out into a channel system that leads up to an actual well tool which thereby is activated to its function by the fluid pressure.

Figure 1:
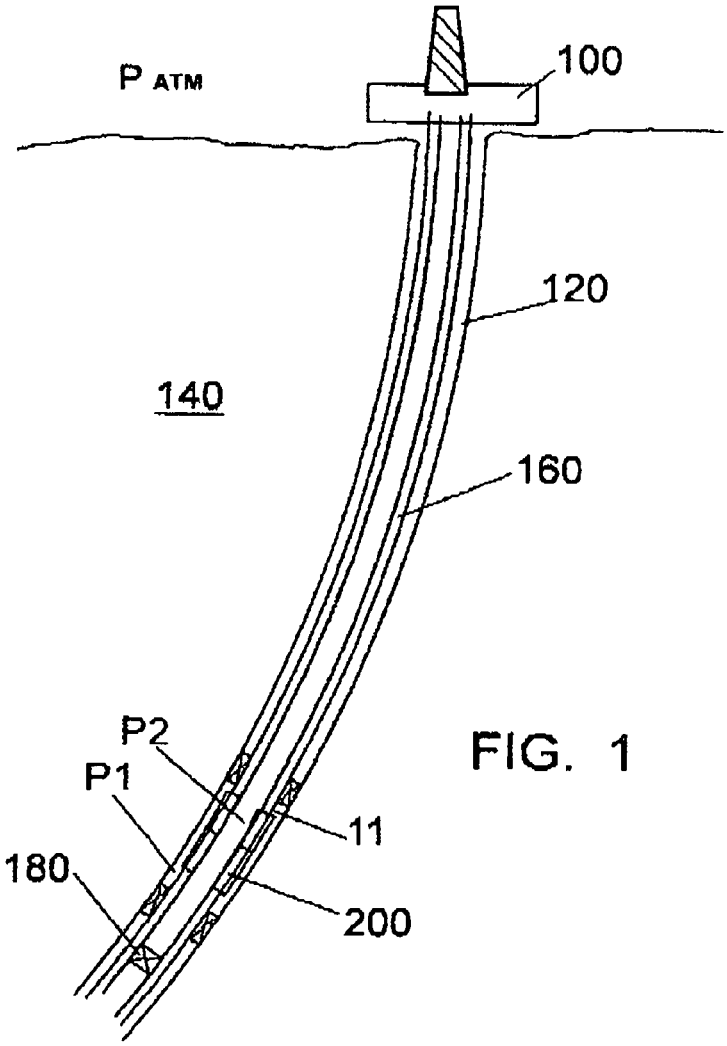
FIG. 1 shows an overview of a cross section partially in perspective, of a typical area of use for the tool according to the invention where it is fitted into a lining pipe or a production pipe that stands in a well which is bored down and through a formation.

Initially, reference shall be made to FIG. 1 which shows a typical area of use for such a release mechanism according to the invention. From a surface installation 100 a well 120 is bored in a formation 140. A pipe 160 is set down into the well 120 that can be a production pipe composed of a number of pipe sections.

In this example the pipe 160 comprises a closing plug 180 at the bottom. A tool section 11 with a release tool 200 according to the invention is fitted in as one of the lowest sections. In this non-limiting example, the tool can be used to operate well equipment both above and below the tool 200, such as the types that activate gaskets, start the crushing of a test plug or open channels for inflow of hydrocarbons from a formation to the production pipe 160 and the like.

Figure 2:
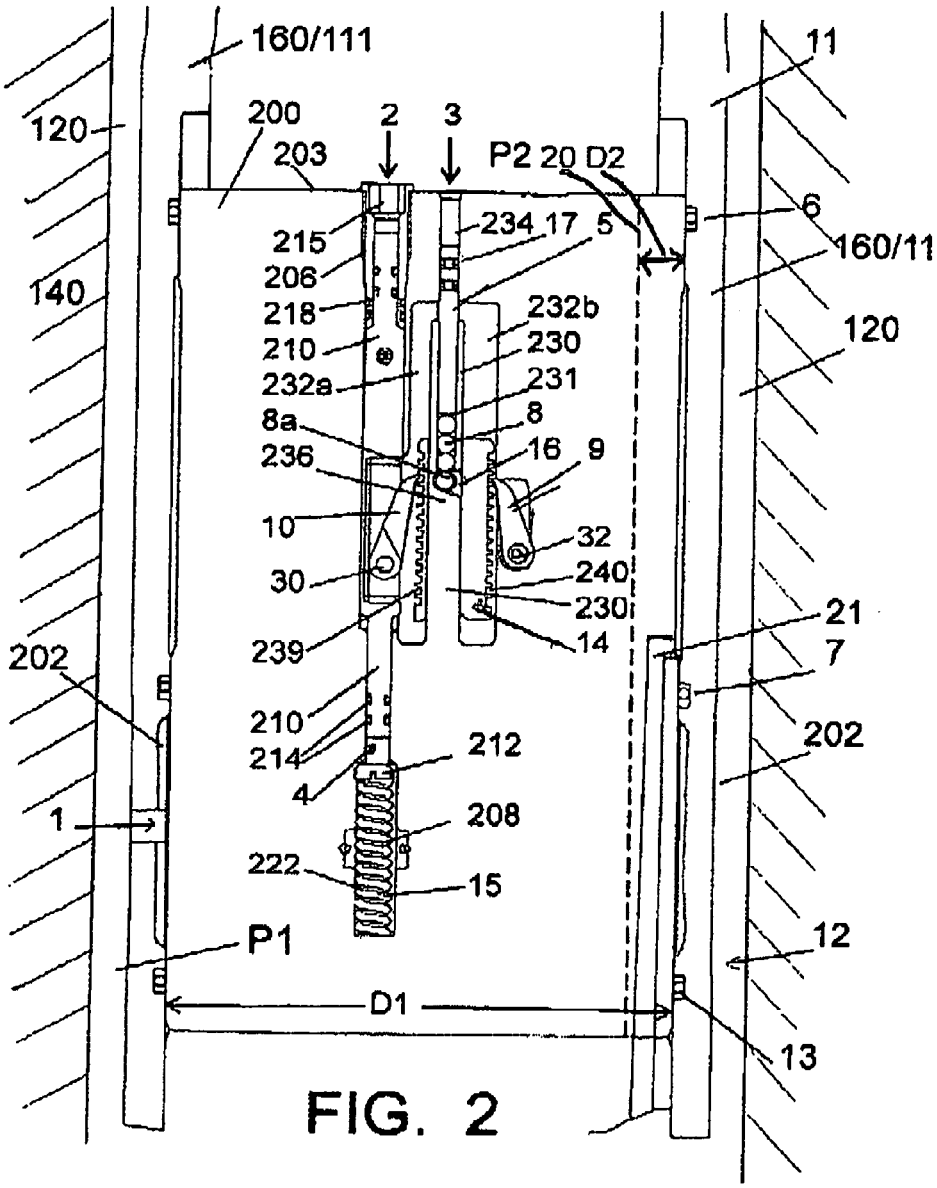
FIG. 2 shows an example of a release tool according to the invention, where the moveable toothed slide of the tool is in its starting position, i.e. before one starts to pulse it by increasing/lowering the fluid pressure in the pipe, in the utilisation of a ratchet function that leads to a unidirectional movement.

The tool 200 with its casing shape, where the wall thickness is indicated by D2, with the release mechanism fitted into the wall of the casing, is consequently inserted in a longer pipe section 11 as is shown in FIG. 2. In the figure the well is shown outside the pipe by 11 and the formation outside this with 140. The tool casing 11 is blocked in and anchored in an internally bored out annular space in the section 11. Also inserted are upper 6 and lower 13 O-ring seals (O-rings) between the casing 200 and the pipe 11 in suitable grooves in the inner wall of the pipe. In addition, inside the lower part of the pipe 11 grooves are made with a larger diameter than the tool/casing 200 diameter D. Thus a ring chamber 202 is formed between the outer side of the casing-formed tool 200 and the inner side of the pipe section.

Furthermore, one or more borings 1 are made through the wall of the pipe section 11 such that the ring chamber around the whole of the circumference is in open fluid connection with the well fluid 120 outside the pipe 11. Just above the chamber 202 a third, middle O-ring seal (O-ring) is also inserted between the casing 200 and the pipe 11 in a suitable groove in the inner wall of the pipe 11. The two ring seals 13 and 7 ensure that the annular space 202 around the circumference is an isolated ring chamber where the fluid pressure is equal to the well pressure P1.

Between the middle seal 7 and the upper seal 6, the pipe 200 is formed with a ring-formed groove with a smaller diameter, for in this area to define an annular space 204, the importance and role of which will be made clear in the description below.

The tool's release mechanisms in the tool are shown in the middle of FIG. 2.

Axially through and inside the wall of the pipe 200, an extended channel 206 is bored out from the top part 203 of the tool casing 200. The channel runs inside in the wall of the pipe. In the bottom 205 the channel forms a bottom chamber 208 with an enlarged diameter with regard to the rest of the channel 206. A piston 210 is inserted in the channel and the bottom 212 of the piston defines a head that has a larger diameter than the rest of the channel, i.e. the head is adjusted to the diameter of the bottom chamber 208. The bottom chamber 208 is open radially outwards (the pipe wall is removed) in this area out towards the annular space 202 so that the whole chamber 208 is exposed to the fluid pressure P1 in the annular space 202 and in the well 120. Just above the chamber 208 sets of ring gaskets 214,216 are inserted to seal the channel 206 above the chamber 208 against the fluid pressure P1. It is only in the annular space 202 that the prevailing well pressure shall exist.

Below the bottom head 212 of the piston rod 210, a tension body is inserted in the bottom chamber 208, such as a spiral spring 15 which, with a given spring force, presses the head 212 up towards the ceiling in the chamber 208, so that the piston 210 is thereby tightened up in its upper position. The top part of the piston 210 is shown by 215.

When the pipe 160 is fitted, the well pressure P1 is often higher than the pipe pressure P2. In the present invention the operation to adjust the density of the well fluid that is led down in the pipe 160 is incorporated so that the pipe pressure P2 stays approximately equal to the well pressure P1, i.e. P1≈P2. During the operation of the present valve tool it is sufficient to increase the well pressure P2 from the surface to a pressure that exceeds the spring force for the piston 210 to be pushed down.

This is an essential feature of the invention, that whatever the depth the valve 200 is fitted, the pipe pressure can simply be adjusted so that the piston 210 is in hydraulic balance and thereby one needs to increase the pipe pressure P2 only, so that this exceeds the pre-stressing force of said spring to push the piston down.

When this pressure P2 is relieved from the surface, the spring pushes the piston up again. Uppermost in the channel 206, there are also fitted ring gaskets 218 against the piston 210. This means that the piston-channel space that is contained within the lower 214 and upper 218 sets of gaskets, respectively, is shielded from both the well fluid pressure P1 and the pipe fluid pressure P2.

Parallel with the piston chamber 206, i.e. next to this in the pipe wall, is yet another chamber 232 formed where the new step or counting mechanism according to the invention is fitted.

The chamber 232 is cut out through the wall of the pipe from the outside corresponding to the spring chamber 208. It comprises two parallel, extended chambers 232*a*, 232*b* which between them define an extended upright 230. From the top side 203 of the casing 200 a channel 234 is bored out down through the wall of the casing and further down through the middle of the upright 230 to about halfway through this, at 236. From this channel bottom 236 the channel is angled so that it runs at an angled channel course with an angle of about 45 degrees with the plunger main channel 234, and out through the side wall of the upright 230 and ends up in an opening out towards the one chamber 232*b*.

From the top side a plunger 5 is inserted into the channel 234, the upper side 237 of which is aligned with the edge of the casing 203, and with a length such that its bottom end 231 lies some distance above the channel bottom 236. In this channel room between the plunger bottom 231 and the channel bottom 236 a number of stopper bodies, such as balls 8 are inserted, the one on top of the other, in this case four balls. The bottom 8*a* of these balls lies steady in the channel at the channel bottom as a consequence of a glider 14 that functions as a stopper/retainer that closes the outlet of the channel, i.e. it ensures that the other, above-lying balls 8 lie at rest in the plunger channel and prevents that they can fall out of the plunger channel until a necessary number of pressure pulses have been carried out, as shall be explained later in this description.

The glider 14 is formed on the two opposite sides with a set of mutually spaced apart cut out teeth 239 and 240, respectively, where the one set of teeth 239 is used, with the help of a first blocking hook 10, to displace the glider 14 stepwise upwards to open the channel opening so that the balls 8 finally fall out. The other set is used, with the help of a second blocking hook 9, to prevent that the glider can glide back down again for each step.

Furthermore, a glider 14 is arranged above the upright 230 that functions as the abovementioned ball stopper. FIG. 2B shows a section of the glider 14 that rides above the upright 230 with two glider parts 14*a* and 14*b* connected to a thinner plate 14*c*. The rows of teeth 239 and 240, respectively, are formed at the opposite facing (here the vertical) glider surfaces 14*a*, 14*b*.

Figure 2A:
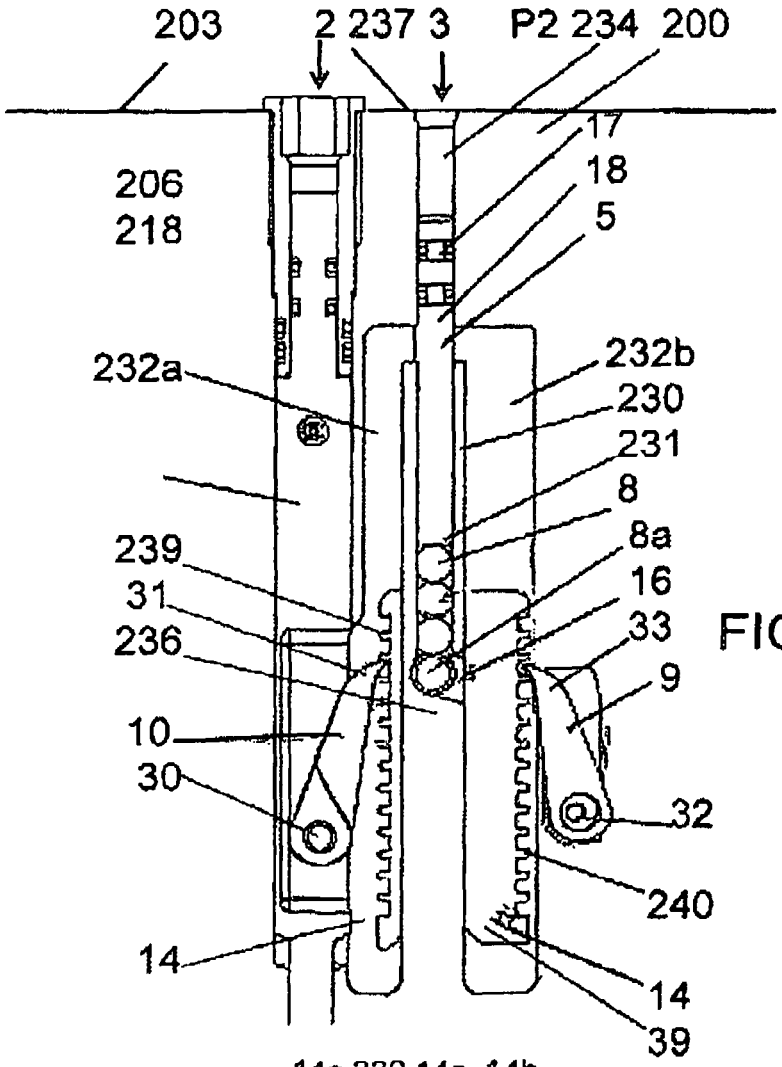
FIG. 2A shows an enlarged section of FIG. 2.
Figure 2B:
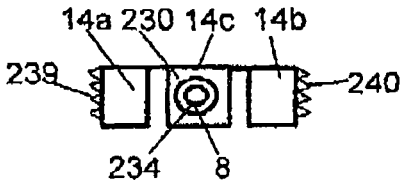
FIG. 2B shows a cross-section of the upright with its plunger boring and which the glider is set up to run along.
Figure 3:
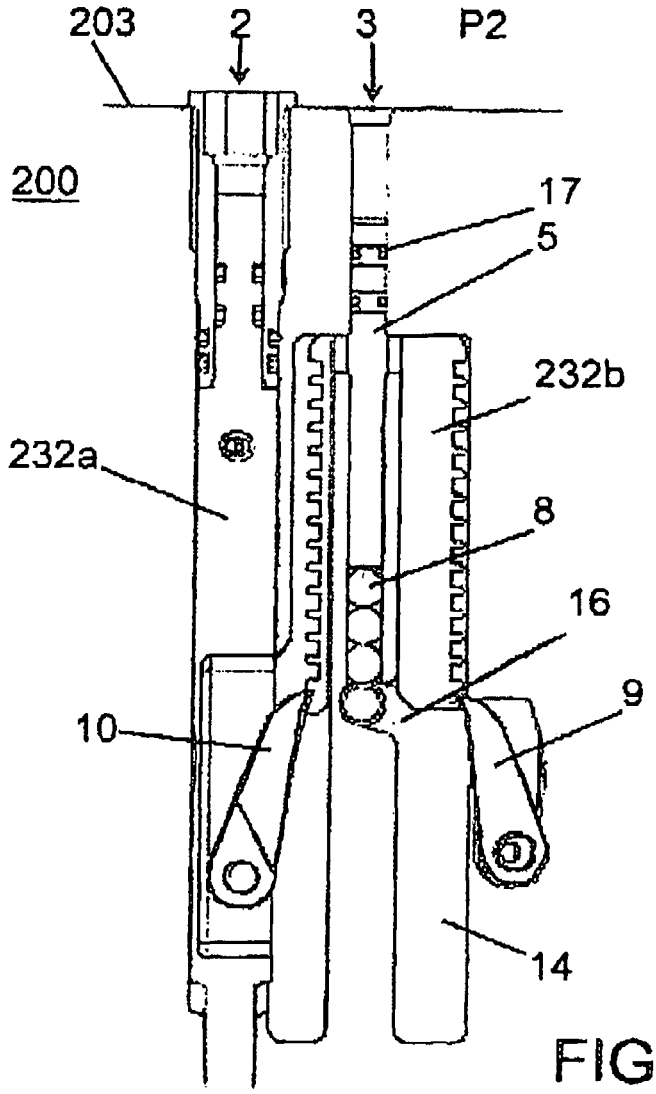
FIG. 3 shows the release mechanism where the toothed slide has moved halfway up the upright.

Said first blocking hook 10, which pushes the glider 14 upwards stepwise, is rotary fastened to the pushable piston 210 at the shaft tap 3, see FIG. 2A. The blocking hook is pre-stressed with the help of a spring inwards and upwards towards the teeth on the glider part 14*a*. It comprises a pointed end 31 that can grip in between the teeth and push the glider upwards when the piston 210 is pushed upwards. Because of the spring effect the blocking hook is bent back and the point 31 will glide along the row of teeth when the piston 210 moves downwards.

The other blocking hook 9 which works on the other slide part 14*b* is shaped correspondingly, but this is rotary fitted in the pipe wall via the shaft 32. Because of the spring effect the blocking hook is bent back and the point 31 will glide along the row of teeth when the piston moves upwards. The blocking hook 9 with its point 33 is correspondingly set up to grip in between the teeth 240 but will be bent back and glide along the row of teeth 240 when the piston 210 pushes the slide upwards. But when the piston 210 is moved downwards, the end of the point 33 will grip in between the teeth 240 and prevent that the slide can glide back or down again. Thus the slide can only move upwards in this system and not downwards. It is moved stepwise upwards for each fluid pulse step which is applied. When the underside 39 of the slide goes past the outlet channel 16, the balls drop under the slide and down into the chamber bottom, something which is shown in FIG. 4. The plunder piston 5 is thereby not blocked by the blocking balls and the fluid pressure P2 will therefore force the piston from above down to the bottom end 231 of the plunger boring.

The blocking hook 30 is fastened to the piston 210 that runs in the piston boring 206. Furthermore, it is set up to rotate in the slide chamber 232*a* to said contact position against the slide in that an extended opening groove or slit is formed in the wall between the boring 206 and the chamber 232, i.e. inside the area that is sealed against the pressures in the pipe and in the well. Through this groove, the blocking hook 10 is rotated to engage with the slide as described above. Consequently, the two blocking hooks are arranged in an approximately tangential direction to the circumference of the pipe material.

The slide chamber 232 is cut out from the outer wall of the pipe casing and is exposed to the ring chamber 204. As the seal sets connected to the plunger piston 234 and the piston 210 completely seal against the well pressure P1, and also that the gaskets 6 and 7 completely seal the casing 200 against the externally lying pipe section, the pressure P3 inside the two chambers 206 and 232 and in the annular space 204 remain completely equal, said pressure will correspond to the atmospheric pressure P-atm (FIG. 1) at which the tool with pistons and slides are fitted together on the surface (on the workshop).

As shown in FIG. 2 a channel 21 runs from the annular space 202, see the arrow P in FIG. 4, in the axial direction in the pipe material and further up to the equipment that shall be operated at the fluid pressure that is released by the stepwise release of the tool, for example, to the opening of a valve, a pipe slide or to a mechanism which shall be able to detonate an explosive charge. In the example shown in FIGS. 1 and 2 it is indicated that this equipment can lie downstream of the tool. However, a channel from the annular space can, of course, also run upwards upstream of the tool.

When the balls fall down into the bottom of the chamber 232 (FIG. 4) the plunger piston 5 is pushed downwards and the pipe fluid at a pressure P2 forces into the chamber 232 and further out into the annular space 202 and further on in the channels 21, see FIG. 2.

The function of the tool shall now be explained in the following:

FIG. 2 shows the valve slide in its initial position. The boring 1 defines a fluid communication transport to the annular space 12 outside the pipe 11 which the counting system of the present tool is installed in. Because of the outer casing pipe 12 forming a joint pressure tight unit up to the surface, this will always have the same hydrostatic pressure independent of if one presses up the pipe 11 internally. The piston 210 is forced down by the applied pressure inside the pipe 11 when the force from the spring 15 is overcome.

Because of the hole 1 in to the annular space between the O-ring 13 and O-ring 7, the piston 210 will always have a support pressure in to the underside 4. The surface area of the top of the piston 210 and the bottom 4 of the piston are the same. Therefore, there one will only need to overcome the pressure force which the spring 15 exerts on the bottom 4 of the piston 210. This pressure will be the same independent of the hydrostatic pressure in the well as the pressure in the annular space between O-ring 7 and O-ring 13 will always be approximately equal to the pressure inside the pipe 11 when this has a hydrostatic pressure only. Thus, one will have a balanced piston 210 which will always return to its initial position as the spring 15 will force it back and up again.

When the piston 210 is forced into the pipe 11 by the pressure, the lifting arm/blocking hook 10, which is spring loaded (the spring is not shown) will slide over the notches/teeth 239 on the glider/slide 14. Thus, the blocking/retainer arm 9 will prevent the glider 14 from following as it is also spring loaded and will therefore hold the slide/glider 14 in a permanent position. When the pressure in the pipe 11 is reduced to hydrostatic pressure, the piston 210 will be lifted by the force from the spring 15. The glider 14 will now follow when the lifting arm 10 has clicked down one notch and now, because of the shape and spring loading, lifts the glider 14 up one notch. The locking arm/retainer arm 9 clicks over one notch and the glider 14 has thereby moved up one position.

The slide 14 has also as its primary task to hold the rollers/balls 8 and also the plunger piston 5 in position as a rigid unit. The plunger valve/piston 5 prevents pressure entering the annular space 232 between O-ring 6 and O-ring 7 through the boring 3.

When the glider 14 is lifted up after the last cycle, the roller/balls 8 will be released as they can now be forced out through the passage 16 which previously was blocked by the glider 14. Now it is also possible to force the plunger piston 9 down in the boring 3 so that the seal on the plunger piston 5 comes under the edge of the pocket 18 which is connected to the annular space 204 in FIG. 2 so that fluid flows in through the opening 19 and pressurises the annular space 204, with the annular space 204 being between O-ring 6 and O-ring 7. The annular space 204 is then in connection with the pressure activated function of the tool further away from the present tool, and this is not shown. The task for the pressure activation can be activation of a casing which is displaced by the pressure, activation of an explosive charge, activation of a ball valve from a closed to an open position, and a number of other tasks can also be regulated to happen at a desired time through controlling when the annular space 204 is pressurised by applying pressure cycles to pipe 11 which is in connection to pressure control equipment on the rig (pumping equipment to pressurise and vent the pressure in the pipe 11).

The invention claimed is:

1. Device for a fluid operated valve body for activation of a fluid operated tool, said valve body can be connected to a pipe section of a pipe arranged in a well in a formation characterised in that said valve body comprises a release body having one end exposed to a fluid pressure in the pipe and an opposite end disposed in a chamber in the pipe section in open fluid connection with the well outside the pipe section, said release body being a piston which is placed in a boring through a wall of said valve body;

a pre-stressing body in said chamber biasing said release body towards said one end against the fluid pressure in the pipe to balance said release body hydraulically whereby said release body is movable in number of stepwise forward and backward movements by increasing and decreasing, respectively, the fluid pressure in the pipe;

a slide body movable in response to movements of said release body; and characterised in that said piston comprises a rotary blocking hook for engaging with said slide body during the movement of said piston upwards for each increase in the fluid pressure in the pipe.

2. Device according to claim 1, characterised in that said pre-stressing body is a spiral spring that holds said release body in a pre-stressed upper position.

3. Device according to claim 1 characterised in that said moveable slide body is arranged in a closed chamber which is sealed against pressure in the well and the fluid pressure in the pipe and where the chamber is set up to have a constant pressure during the whole of pulse operation flows.

4. Device according to claim 3 characterised in that said blocking hook is fastened to said piston to rotate in an area of said boring sealed against pressure in the well and the fluid pressure in the pipe and to pass through a slit in a wall separating a chamber containing said piston from a chamber containing said slide body.

5. Device according to claim 4 characterised in that a second blocking hook is rotary fastened in the pipe wall to engage said slide body when said piston pushes said slide body upwards, and to prevent said slide body from moving back when said piston is pushed down.

6. Device according to claim 3 characterised in that said closed chamber is made up of two extended channels defining an extended upright therebetween and communicating at one end with a channel extending to the top side of said valve body and at an opposite end with the well outside the pipe section.

7. Device according to claim 6 characterised in that a plunger is inserted in said upright with a length so that its bottom end lies some distance above the bottom of said upright, and a number of balls are inserted between the plunger bottom and the channel bottom, the one on top of the other.

8. Device according to claim 7 characterised in that said balls are held in place in the bottom of said upright as a consequence of said slide body blocking an outlet from said upright.

9. Device according to claim 3 characterised in that said chamber in the pipe section containing said spring and said closed chamber containing said slide body are cut out of an outer wall of the pipe.

10. Device according to claim 7 characterised in that said slide body comprises a number of teeth for engagement by said rotary blocking hook with the number of teeth corresponding to the number of pressure pulses that must be carried out to push said slide body so far up that said balls pass out from the bottom of said upright and said plunger is free to move downwardly under the fluid pressure in the pipe.

11. Method for opening of a fluid stream through a release valve in connection to a pipe section in a well, characterised in that 1) an increased fluid pressure is set up in the pipe so that a piston in the wall section of the valve is pushed down against a pre-stressed force, 2) the pressure is released and the spring pushes the piston back, which leads to that a blocking hook, fitted to the piston so that it can flip, engages with and pushes a slide one step upwards, while another of the blocking hooks of the pipe engages with and prevents the slide from being pushed down again, 3) the steps 1 to 2 are repeated until the slide releases a channel so that blocking bodies in the form of balls fall out of the channel, and a plunger piston falls down and provides an opportunity for the pipe fluid to flow into the slide chamber in the wall of the pipe casing, and further out into a channel system that can lead up to the operation of various equipment in connection to a pipe stem where the release valve is fitted.

12. Method according to claim 11, characterised in that the slide is moved when the pipe pressure is partially released or completely released, so that the pipe pressure P2 is at its lowest when the fluid is let into the channel system.

* * * * *

UNITED STATES PATENT AND TRADEMARK OFFICE

CERTIFICATE OF CORRECTION

PATENT NO. : 9,234,405 B2
APPLICATION NO. : 13/511554
DATED : January 12, 2016
INVENTOR(S) : Viggo Brandsdal It is certified that error appears in the above-identified patent and that said Letters Patent is hereby corrected as shown below:

Specification

Column 1, line 10, "13" should be – 11 –

Column 2, lines 64-65, delete "The … 6-12."

Signed and Sealed this
Nineteenth Day of April, 2016

Michelle K. Lee

Michelle K. Lee
*Director of the United States Patent and Trademark Office*